US011000938B2

(12) United States Patent
Li

(10) Patent No.: US 11,000,938 B2
(45) Date of Patent: May 11, 2021

(54) RATCHET DEVICE

(71) Applicant: Jen-Kai Li, Taichung (TW)

(72) Inventor: Jen-Kai Li, Taichung (TW)

( * ) Notice: Subject to any disclaimer, the term of this patent is extended or adjusted under 35 U.S.C. 154(b) by 0 days.

(21) Appl. No.: 15/964,226

(22) Filed: Apr. 27, 2018

(65) Prior Publication Data

US 2019/0329383 A1 Oct. 31, 2019

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
CPC ..... B25B 13/463; B25B 23/0035
USPC ..... 81/63.1
See application file for complete search history.

(56) References Cited

U.S. PATENT DOCUMENTS 1,072,807 A * 9/1913 Ayer ..... F16D 41/16 192/43.1
3,127,799 A * 4/1964 Bergquist ..... B25B 13/463 81/62
4,811,636 A * 3/1989 Okura ..... B25B 13/463 81/63
6,457,389 B1 * 10/2002 Hu ..... B25B 13/463 81/60
6,935,213 B2 * 8/2005 Shu-Sui ..... B25B 13/463 81/63
7,107,877 B2 * 9/2006 Lee ..... B25B 13/465 192/43.1
8,931,374 B2 * 1/2015 Chen ..... B25B 13/06 81/63.1
2015/0239106 A1 * 8/2015 Wang ..... B25B 13/465 81/63.2

* cited by examiner

*Primary Examiner* — Hadi Shakeri
(74) *Attorney, Agent, or Firm* — Alan D. Kamrath; Karin L. Williams; Mayer & Williams PC

(57) ABSTRACT

A ratchet device contains: a base, a ratchet head, at least one retainer, and a direction control mechanism. The base includes at least one accommodation portion. The ratchet head is accommodated in the at least one accommodation portion and includes a first fitting portion and a toothed portion. The at least one retainer is accommodated in the at least one accommodation portion and includes at least one locking tooth. The direction control mechanism includes a rotatable driving loop having at least one engagement portion, and the direction control mechanism includes at least one actuation element. Each of the at least one actuation element has a first pushing element and a second pushing element, wherein the first pushing element is biased against each of the at least one engagement portion, and the second pushing element abuts against each of the at least one retainer.

9 Claims, 13 Drawing Sheets

A – A

B — B

C – C

D – D

RATCHET DEVICE

FIELD OF THE INVENTION

The present invention relates to a ratchet device which contains a rotatable driving loop configured to switch an operation direction of the ratchet device and to operate the direction control mechanism of the ratchet device stably and easily.

BACKGROUND OF THE INVENTION

A conventional ratchet device of small size is applied to connect/remove a bolt with/from an object by matching with an operation tool (such as a socket), such that the ratchet device is gripped by user's hand and is pressed by a palm of the user's hand so as to drive the operation tool to connect or remove the bolt tool.

Referring to 1-2, a conventional ratchet device 10 contains a base 11 having an accommodation groove 111 defined in the base 11, a toothed portion 112 arranged on an inner wall of the accommodation groove, and a control member 12 in which an engagement block 13 is accommodated, wherein the engagement block 13 has multiple locking teeth. The base 11 also has a rotatable disc 14 housed in a first end thereof and configured to control the engagement block 13 to offset, a quadrangular column 121 extending from a second end of the base 11 so as to fit with the operation tool (not shown), such as a socket.

The control member 12 is received in the accommodation groove 111 of the base 11, the quadrangular column 121 extends out of a bottom of the base 11, and the multiple locking teeth of the engagement block 13 engage with the toothed portion 112 of the base 11. The rotatable disc 14 extends out of a top of the base 11 so that the user switches an operation direction of the ratchet device 10, and a fastening loop 15 connects the control member 12 with the base 11.

In operation, the quadrangular column 121 of the control member 12 is fitted with the socket (not shown). The user's hand grips the base 11 and its palm presses the rotatable disc 14 of the base 11 so as to drive the base 11 to rotate, such that the quadrangular column 121 of the control member 12 actuates the socket to rotate simultaneously, thus connecting or removing the bolt member.

As desiring to change the operation direction of the ratchet device 10, the rotatable disc 14 of the base 11 is rotated so as to switch the multiple locking teeth of the engagement block 13 to engage with the toothed portion 112 of the base 11.

However, the ratchet device 10 has defects as follows:

1. When the user's hand grips the base 11 and its palm presses the rotatable disc 14 to revolve, the user's hand touches the rotatable disc 14 to rotate uncarefully, thus changing the operation direction of the ratchet device 10 (i.e., idly rotating the ratchet device).

2. A fitting trench cannot be defined in a top of the control member 12 of the base 11, because the rotatable disc 14 extends out of the top of the base 11. In addition, the quadrangular column 121 is fitted with the socket and cannot match with other drive tool (such as a tool bar), hence the user's hand has to exert large force to operate the ratchet device 10.

The present invention has arisen to mitigate and/or obviate the afore-described disadvantages.

SUMMARY OF THE INVENTION

The primary aspect of the present invention is to provide a ratchet device which switches its operation direction easily and removes or connects the bolt element stably.

Further aspect of the present invention is to provide a ratchet device which avoids occupying the second end of the base so that the second fitting portion is arranged on the second end of the base and mates with a drive tool by way of the ratchet device, thus saving operation force.

Another aspect of the present invention is to provide a ratchet device which avoids an idle rotation of the ratchet device.

To obtain above-mentioned aspects, a ratchet device provided by the present invention contains: a base, a ratchet head, at least one retainer, and a direction control mechanism.

The base includes at least one accommodation portion arranged in a first end thereof.

The ratchet head is accommodated in the at least one accommodation portion of the base and includes a first fitting portion and a toothed portion.

The at least one retainer is accommodated in the at least one accommodation portion of the base and includes at least one locking tooth configured to engage with the toothed portion of the ratchet head.

The direction control mechanism includes a rotatable driving loop fitted with an outer rim of the base and having at least one engagement portion, at least one actuation element accommodated in the base and driven by the rotatable driving loop to rotate. Each of the at least one actuation element has a first pushing element and a second pushing element opposite to the first pushing element, wherein the first pushing element is biased against each of the at least one engagement portion of the rotatable driving loop, and the second pushing element abuts against each of the at least one retainer.

DETAILED DESCRIPTION OF THE PREFERRED EMBODIMENTS

Figure 1:
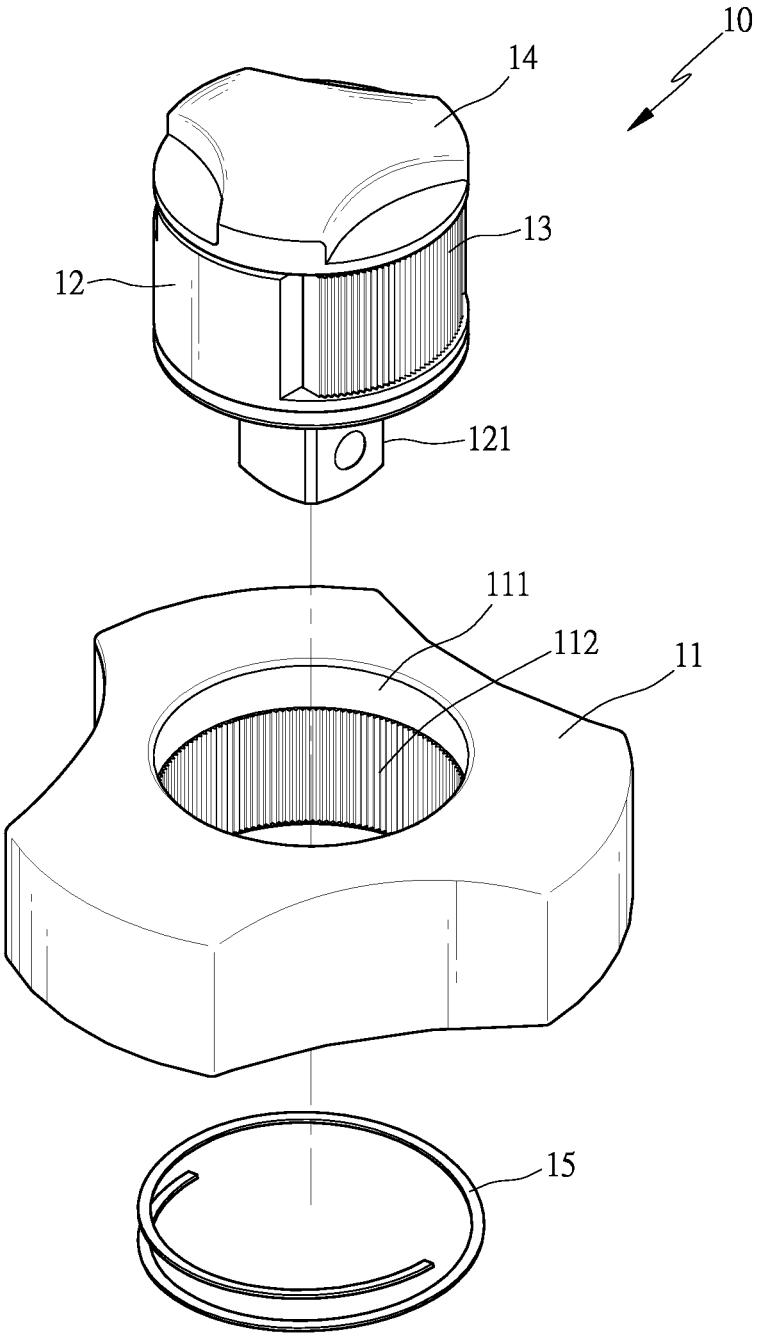
F I G . 1 PRIOR ART
FIG. 1 is a perspective view showing the exploded components of a conventional ratchet device.
Figure 2:
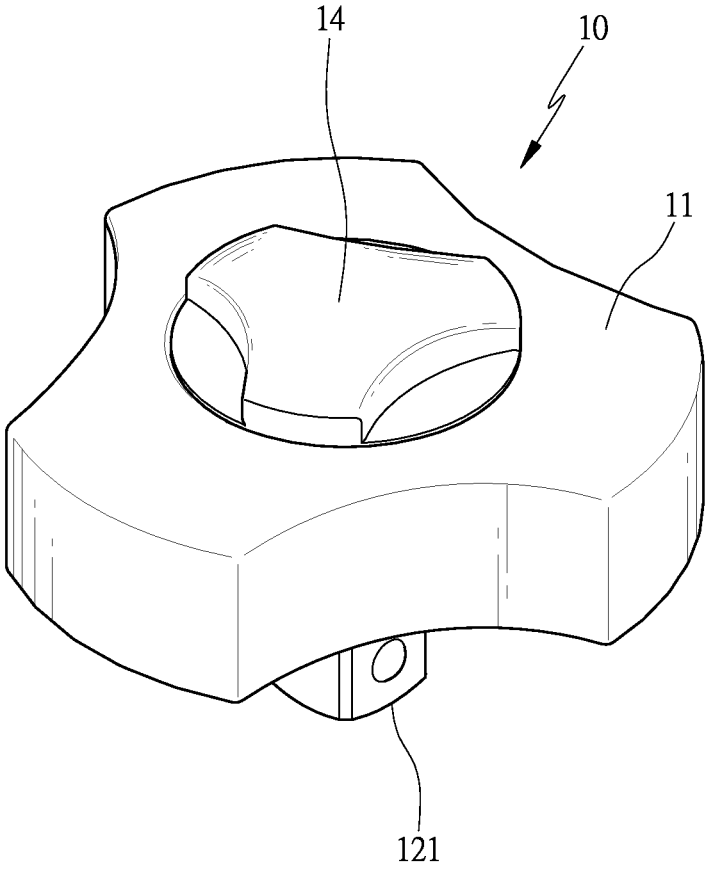
F I G . 2 PRIOR ART
FIG. 2 is a perspective view showing the assembly of the conventional ratchet device.
Figure 3:
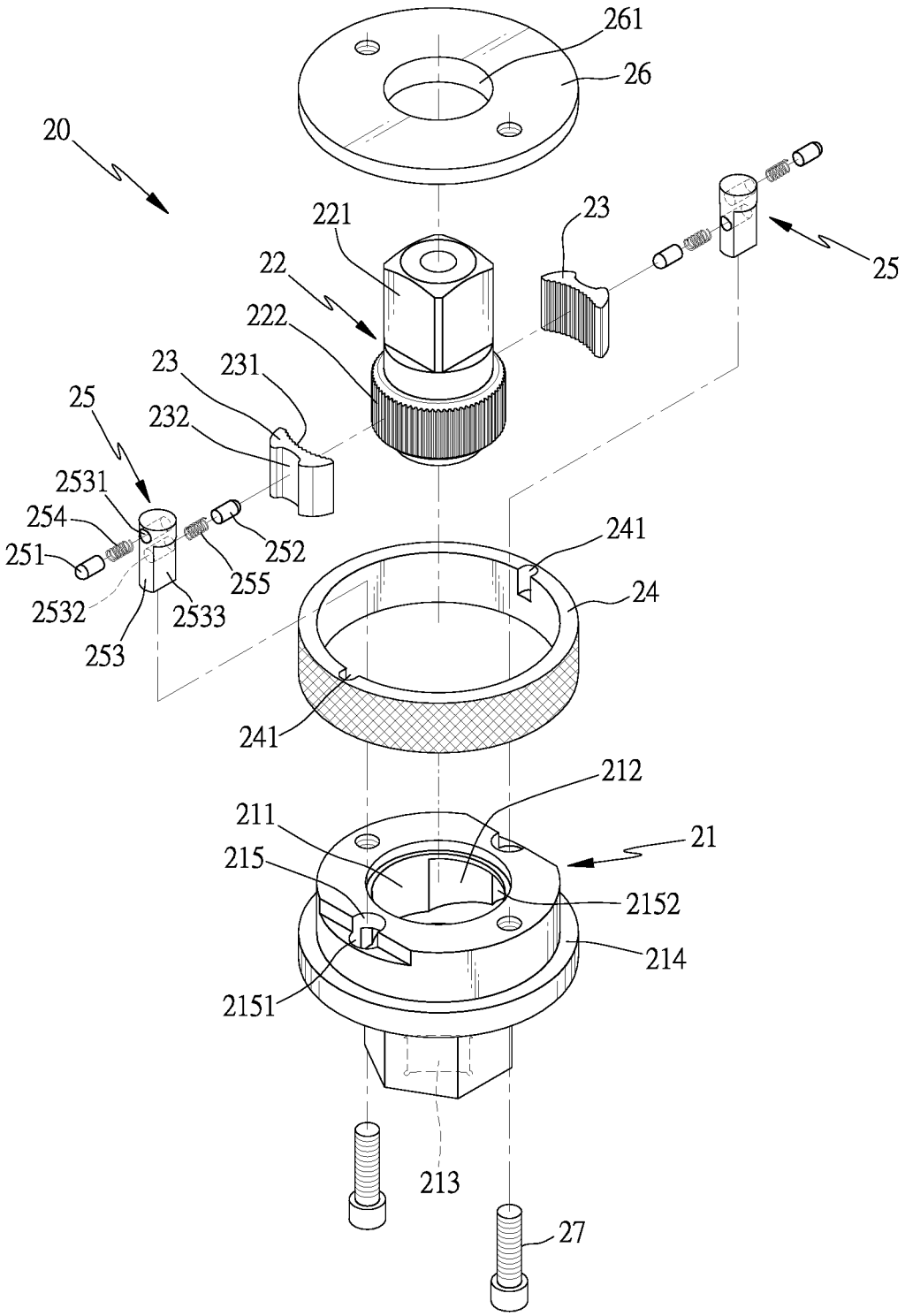
FIG. 3 is a perspective view showing the exploded components of a ratchet device according to a preferred embodiment of the present invention.
Figure 4:
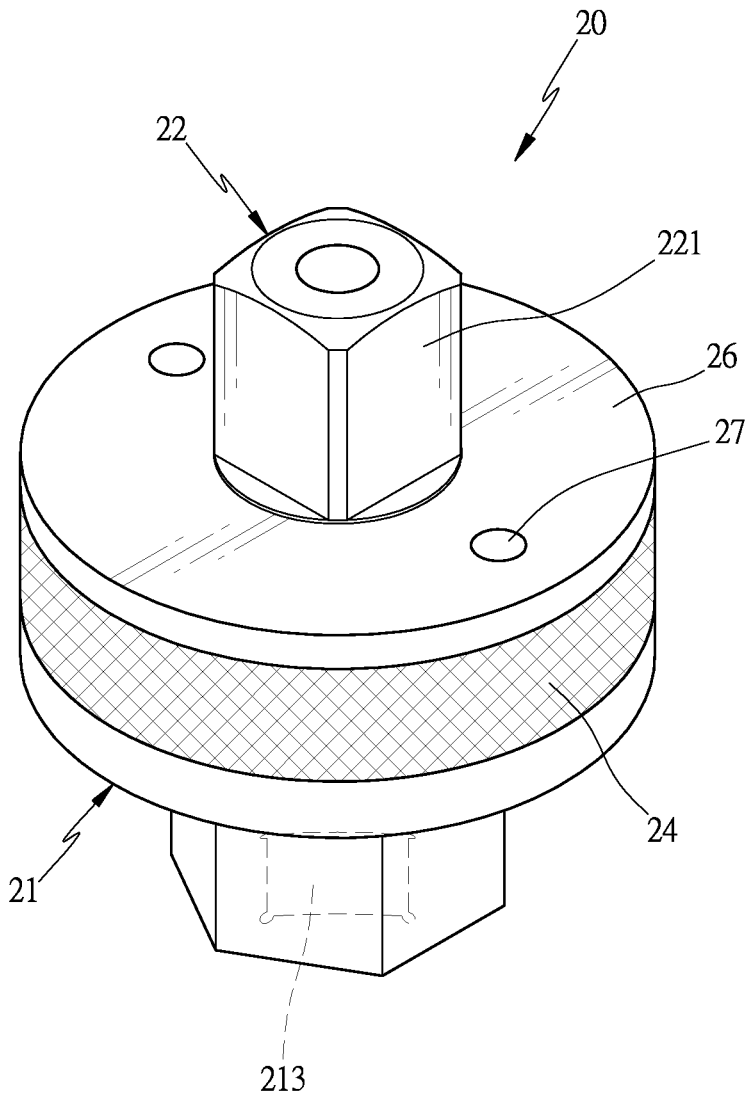
FIG. 4 is a perspective view showing the assembly of the ratchet device according to the preferred embodiment of the present invention.
Figure 5:
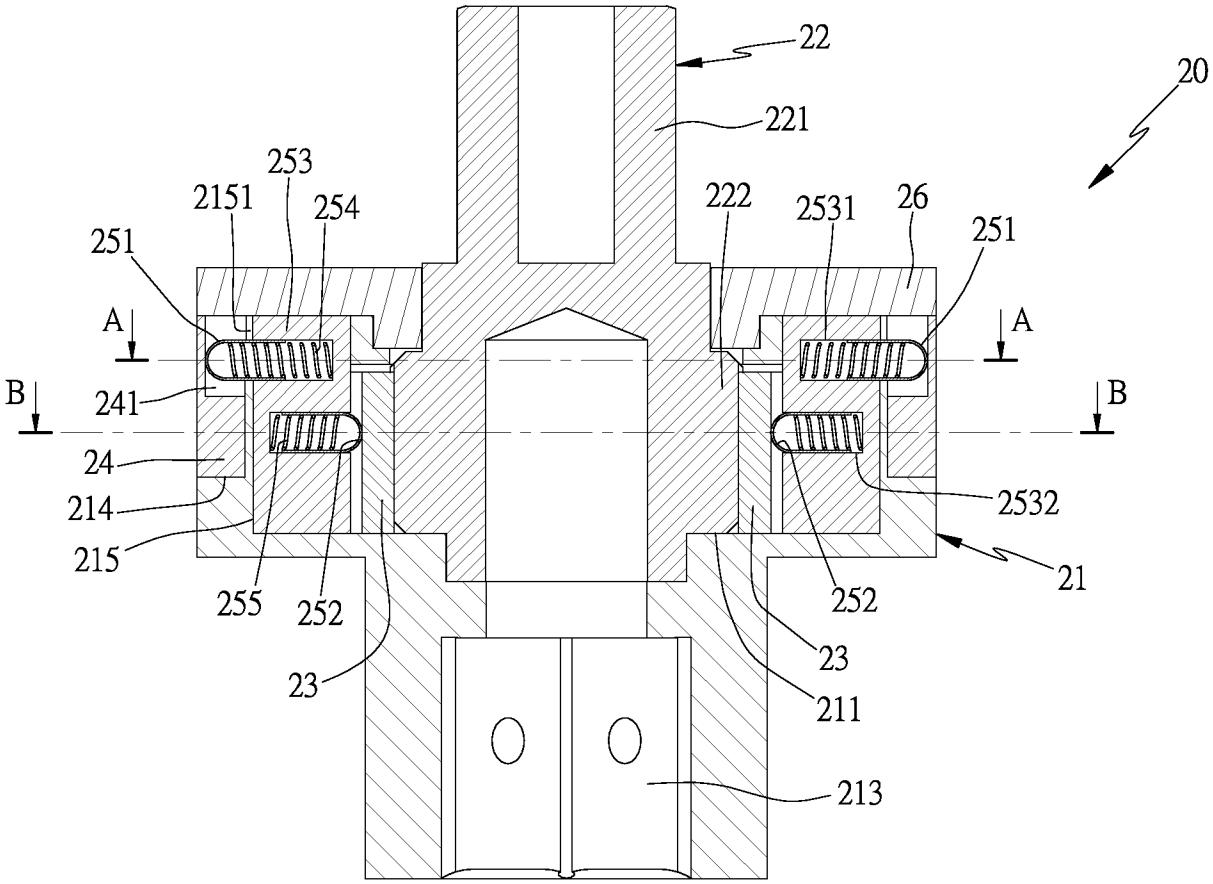
FIG. 5 is a cross sectional view showing the assembly of the ratchet device according to the preferred embodiment of the present invention.
Figure 6:
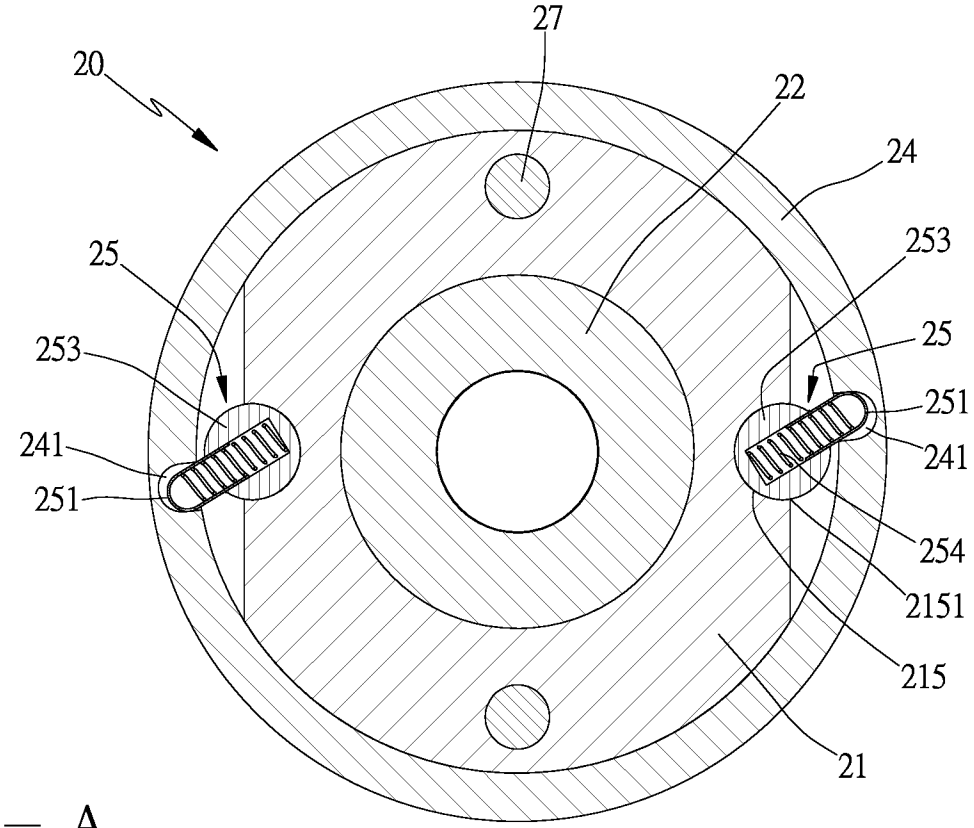
FIG. 6 is a cross sectional view taken along the line A-A of FIG. 5.
Figure 7:
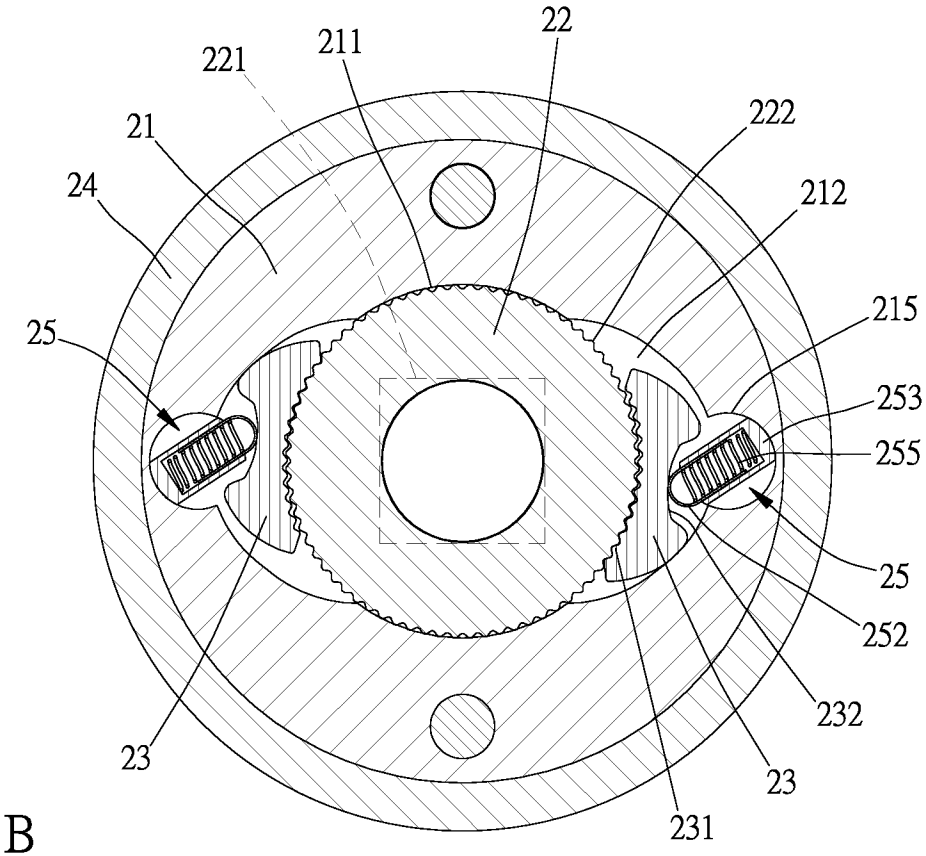
FIG. 7 is a cross sectional view taken along the line B-B of FIG. 5.

With reference to FIGS. 3-7, a ratchet device 20 according to a preferred embodiment of the present invention comprises: a base 21, a ratchet head 22 including a first fitting portion, at least one retainer 23, and a direction control mechanism.

The base 21 includes at least one accommodation portion arranged in a first end thereof, in this embodiment, the base 21 includes a first accommodation portion 211 arranged in the first end thereof and two second accommodation portions 212 communicating with the first accommodation portion 211. The base 21 further includes a second fitting portion 213 configured to fit with an operation tool or a drive tool, wherein the second fitting portion 213 is a polygonal orifice or a polygonal column. In this embodiment, the base 21 includes a stem extending outward from a second end thereof, and the stem has the second fitting portion 213 formed therein in a quadrilateral orifice so as to fit with the drive tool, such as a tool bar (not shown).

The ratchet head 22 is accommodated in the at least one accommodation portion of the base 21 and includes the first fitting portion 221 and a toothed portion 222. In this embodiment, the ratchet head 22 includes the first fitting portion 221 formed on a first end thereof and in a quadrilateral cylinder shape, and the ratchet head 22 includes a toothed portion 222 arranged on an outer wall of a second end of the ratchet head 22, wherein the toothed portion 222 is housed in the first accommodation portion 211, and the first fitting portion 221 extends out of the base 21 so as to fit with the operation tool, such as a socket (not shown).

The at least one retainer 23 is accommodated in the at least one accommodation portion of the base 21 and includes at least one locking tooth 231 configured to engage with the toothed portion 222 of the ratchet head 22. In this embodiment, the ratchet device 20 comprises two retainers 23, and each of the two retainers 23 includes multiple engagement teeth 231 formed on a first surface of each retainer 23 and a push portion 232 arranged on a second surface of each retainer 23. In assembly, the two retainers 23 are accommodated in the two second accommodation portions 212 of the base 21 respectively, wherein the multiple engagement teeth 231 of each retainer 23 engage with the toothed portion 222 of the ratchet head 22.

The direction control mechanism includes a rotatable driving loop 24 fitted with an outer rim of the base 21 and having at least one engagement portion 241. The rotatable driving loop 24 is fixed on a protruded holding portion of the base 21, alternatively, a retaining ring and a housing groove are defined between the rotatable driving loop 24 and the base 21, wherein the retaining ring mates with the housing groove so that the rotatable driving loop 24 is fitted with and rotates on the outer rim of the base 21. In this embodiment, the base 21 includes the protruded holding portion 214 formed on the outer rim thereof, and the rotatable driving loop 24 has two engagement portions 241 formed on an inner rim thereof in an indentation shape so as to rotatably fit with the outer rim of the base 21 and to fix on the protruded holding portion 214. The direction control mechanism further includes at least one actuation element 25 accommodated in the base 21 and driven by the rotatable driving loop 24 to rotate. Each of the at least one actuation element 25 has a first pushing element 251 and a second pushing element 252 opposite to the first pushing element 251, wherein the first pushing element 251 is biased against each of the two engagement portions 241 of the rotatable driving loop 24, and the second pushing element 252 abuts against each retainer 23 so that the multiple engagement teeth 231 of each retainer 23 engage with the toothed portion 222 of the ratchet head 22.

The direction control mechanism further includes at least one aperture 215 configured to house the at least one actuation element 25. In this embodiment, the base 21 includes two apertures 215 defined on the first end thereof, each of the two apertures 215 has a first open portion 2151 communicating with the outer rim of the base 21, and each aperture 215 has a second open portion 2152 communicating with each of the two second accommodation portions 212. Each actuation element 25 has a first receiving hole 2531 and a second receiving hole 2532 which are defined on a body 253 of each actuation element 25, wherein the first receiving hole 2531 accommodates a first resilient element 254 which is a spring, and the first receiving hole 2531 also accommodates the first pushing element 251 so that the first pushing element 251 is pushed by the first resilient element 254 to move. The second receiving hole 2532 accommodates a second resilient element 255 which is the other spring, and the second receiving hole 2532 also accommodates the second pushing element 252 so that the second pushing element 252 is pushed by the second resilient element 255 to move. Each actuation element 25 further has two recessed portions 2533 individually arranged on two sides of a lower end of the body 253 so as to accommodate a part of each retainer 23. When the body 253 of each actuation element 25 inserts into each aperture 215 of the base 21, the first pushing element 251 extends out of the first open portion 2151 of each aperture 215 so as to abut against each engagement portion 241 of the rotatable driving loop 24, and the second pushing element 252 extends out of the second open portion 2152 of each aperture 215 so as to abut against the push portion 232 of each retainer 23, hence the rotatable driving loop 24 drives each retainer 23 to offset by way of the first pushing element 251 and the second pushing element 252 so as to switch an operation direction of the ratchet device 20.

A cap 26 is covered on the base 21 so as to limit the ratchet head 22, the rotatable driving loop 24, and the at least one actuation element 25. In this embodiment, the cap 26 includes a through hole 261 so that the first fitting portion 221 of the ratchet head 22 extends out of the through hole 261, and multiple screw elements 27 screw the cap 26 on the first end of the base 21 so that the cap 26 covers the rotatable driving loop 24 and the at least one actuation element 25, thus fixing the rotatable driving loop 24 and the at least one actuation element 25 in the base 21.

Figure 8:
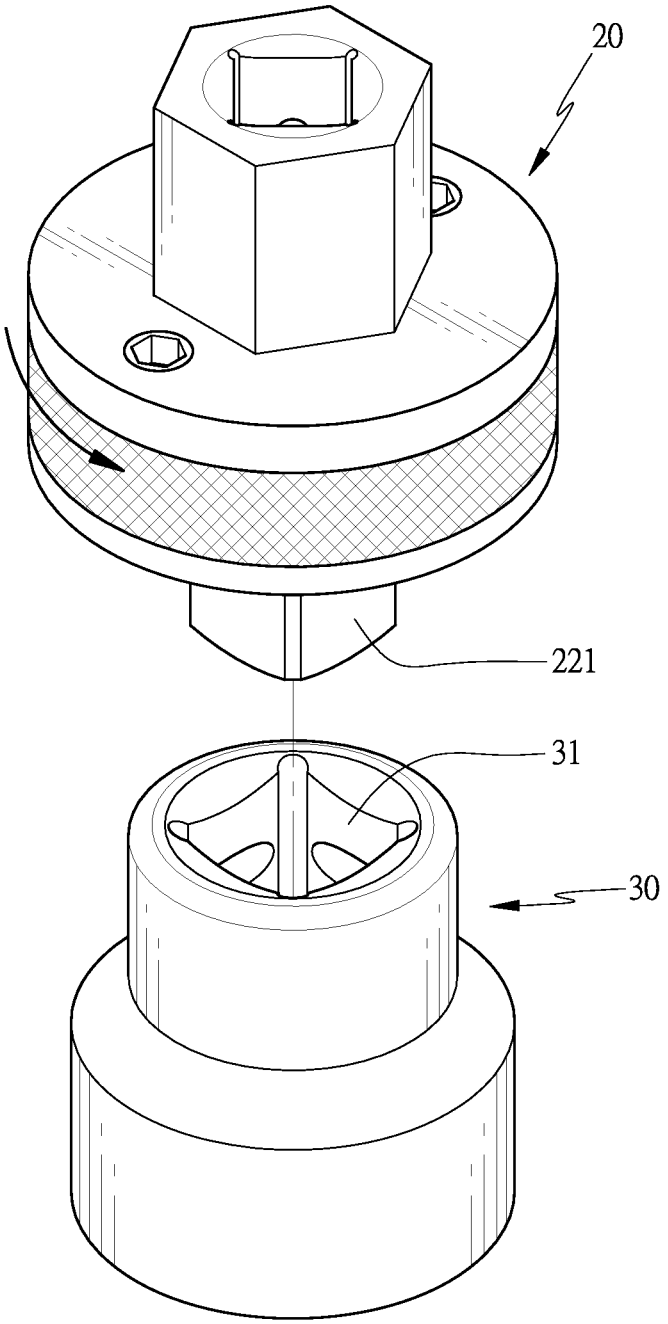
FIG. 8 is a perspective view showing the application of the ratchet device according to the preferred embodiment of the present invention.
Figure 9:
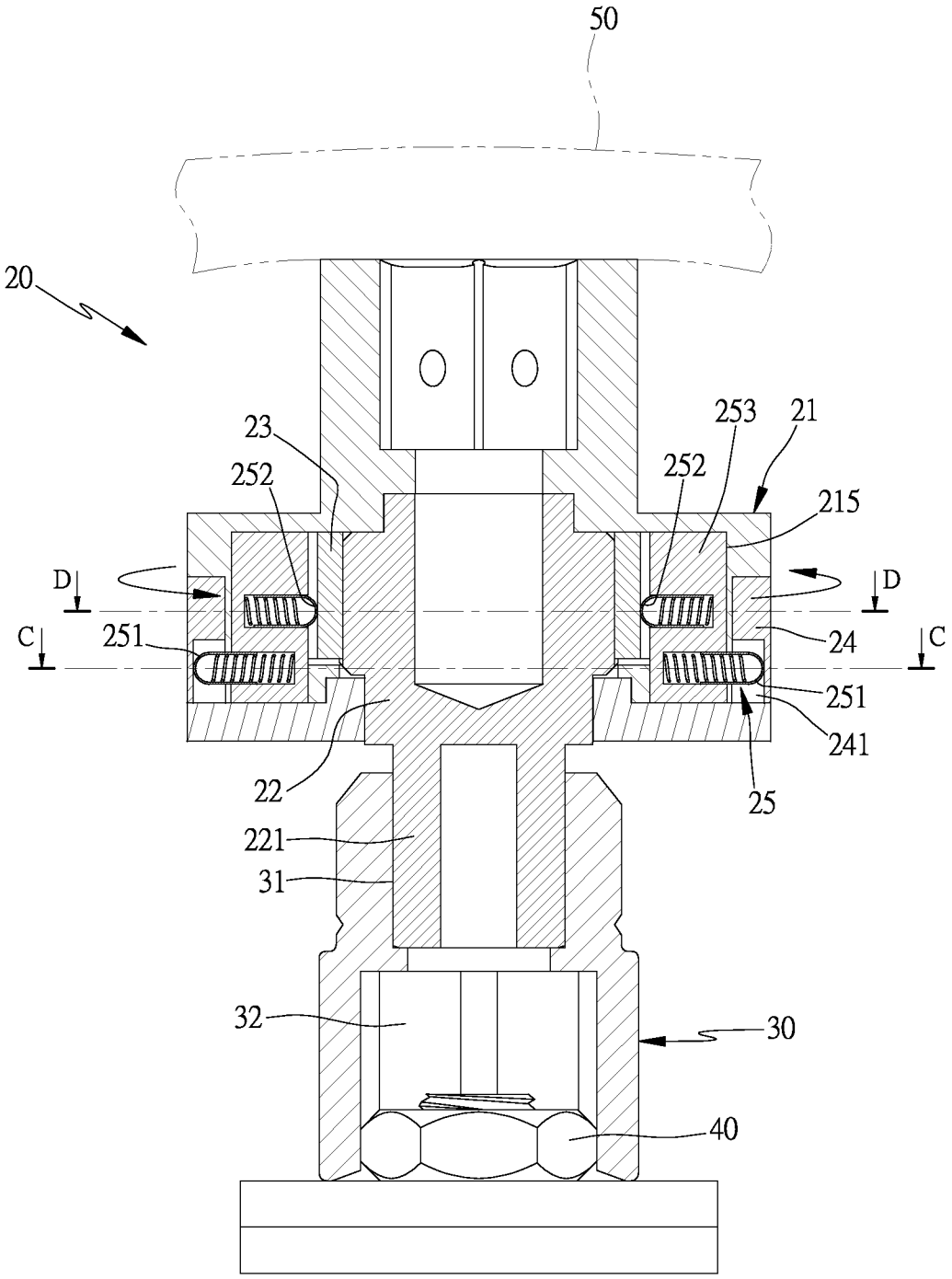
FIG. 9 is a cross sectional view showing the application of the ratchet device according to the preferred embodiment of the present invention.

Referring to FIGS. 8 and 9, in operation, the first fitting portion 221 of the ratchet head 22 is fitted with a connection portion 31 of the socket 30, and an operating portion 32 of the socket 30 is fitted with a bolt element 40. When the ratchet device 20 is gripped by user's hand 50 and the second end of the base 21 is pressed by a palm of the user's hand, the base 21 rotates the rotatable driving loop 24 counterclockwise by switching an operation direction of the ratchet device 20.

Figure 10:
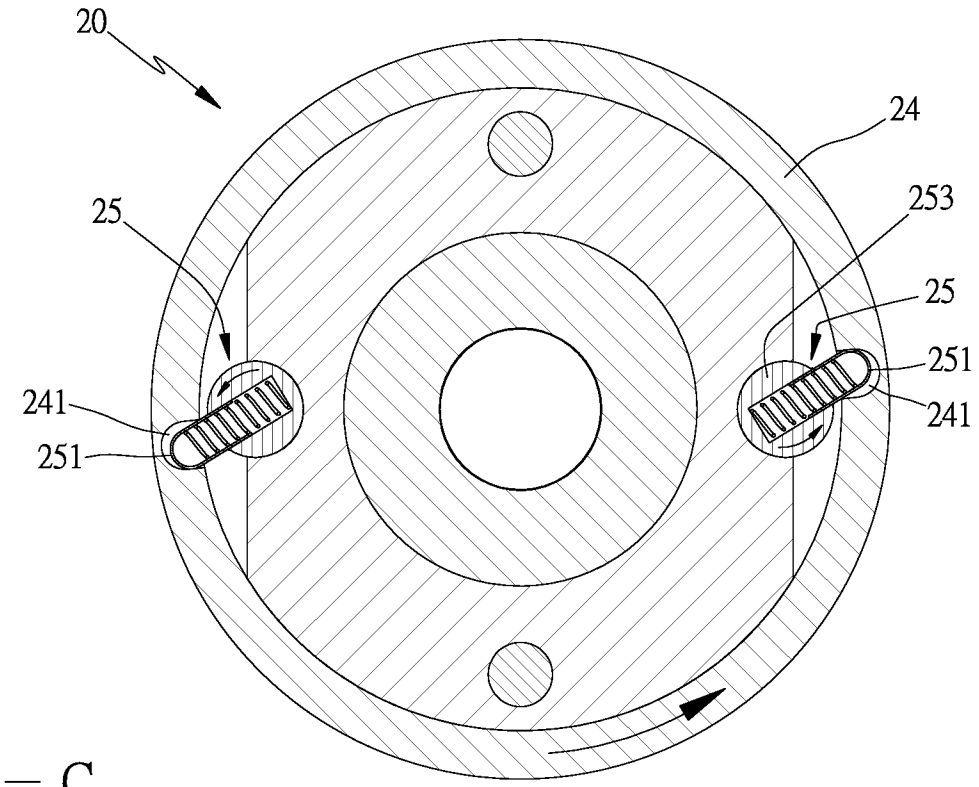
FIG. 10 is a cross sectional view taken along the line C-C of FIG. 9.
Figure 11:
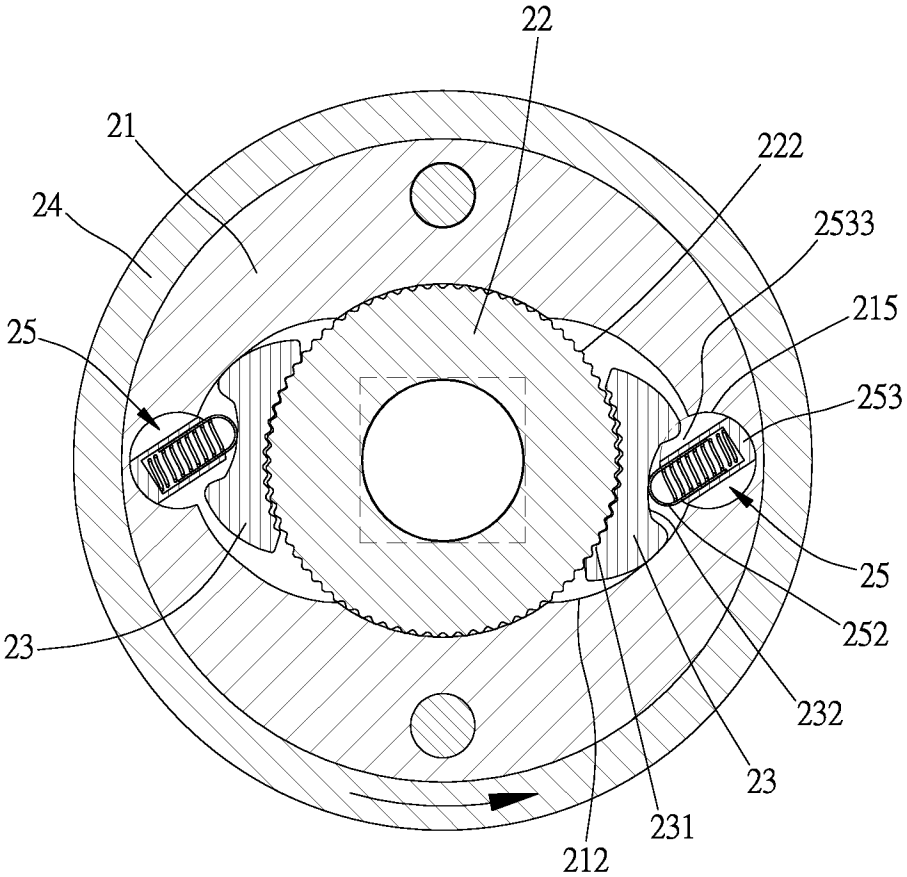
FIG. 11 is a cross sectional view taken along the line D-D of FIG. 9.

As shown in FIGS. 9-11, when the rotatable driving loop 24 is rotated counterclockwise, each engagement portion 241 of the rotatable driving loop 24 pushes the first pushing element 251 of each actuation element 25 to urge the body 253 to rotate counterclockwise, and the body 253 revolves in each aperture 215 so as to actuate the second pushing element 252 to rotate reversely and to push the push portion 232 of a retainer 23, such that the retainer 23 offsets so that the multiple engagement teeth 231 of the retainer 23 engage with the toothed portion 222 of the ratchet head 22 and each second accommodation portions 212 of the base 21, and the retainer 23 swings to each recessed portion 2533 of the body 253, thus switching the operation direction of the ratchet device 20.

Figure 12:
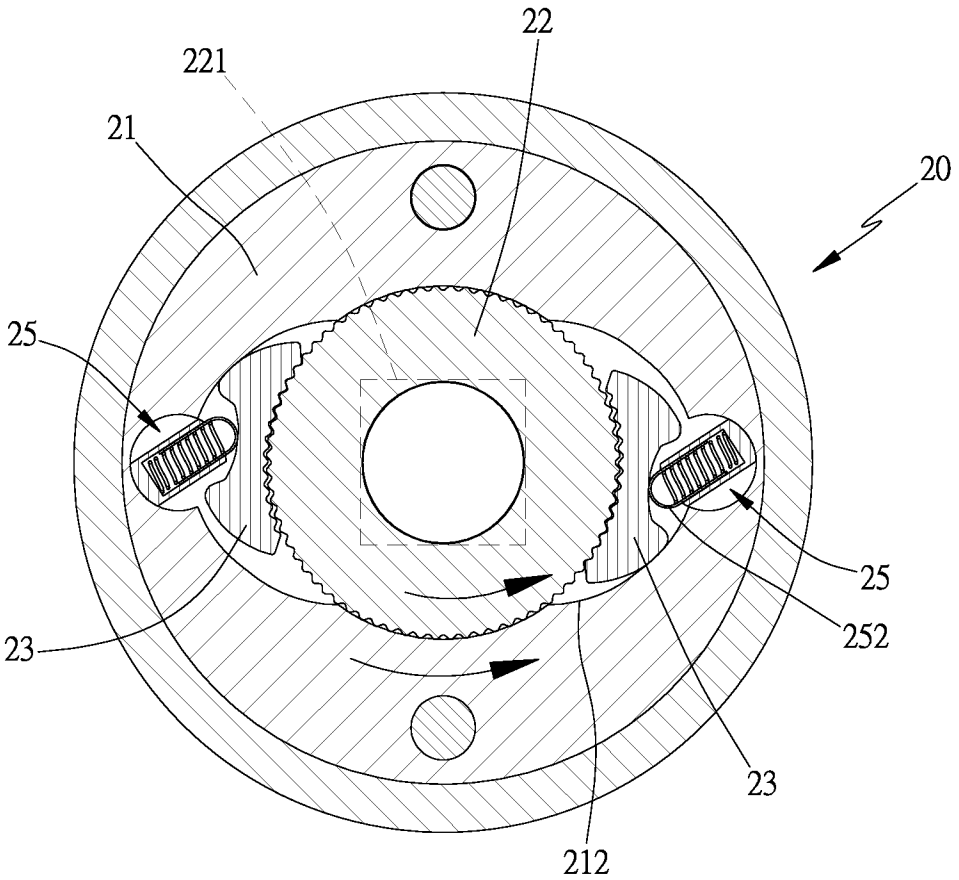
FIG. 12 is another cross sectional view showing the operation of the ratchet device according to the preferred embodiment of the present invention.

As illustrated in FIGS. 9 and 12, after the retainer 23 contacts with each second accommodation portion 212 of the base 21, the base 21 is rotated counterclockwise by user so that the second accommodation portion 212 pushes the other retainer 23 to drive the ratchet 22 to revolve counterclockwise, such that the first fitting portion 221 of the ratchet head 22 actuates the socket 30 to rotate counterclockwise, and the operating portion 32 of the socket 30 removes the bolt element 40. In contrast, when the base 21 is rotated clockwise, the ratchet device 20 revolves idly. Thereafter, the palm of the user's hand 50 presses the second end of the base 21 to rotate, thus the ratchet device 20 detaches the bolt element. When the rotatable driving loop 24 drives each retainer 23 to engage with the ratchet head 22 by way of the first pushing element 251 and the second pushing element 252 of each actuation element 25, a rotation direction of the rotatable driving loop 24 is the same as the operation direction of the ratchet device 20, thus avoiding an idle rotation of the ratchet device.

Figure 13:
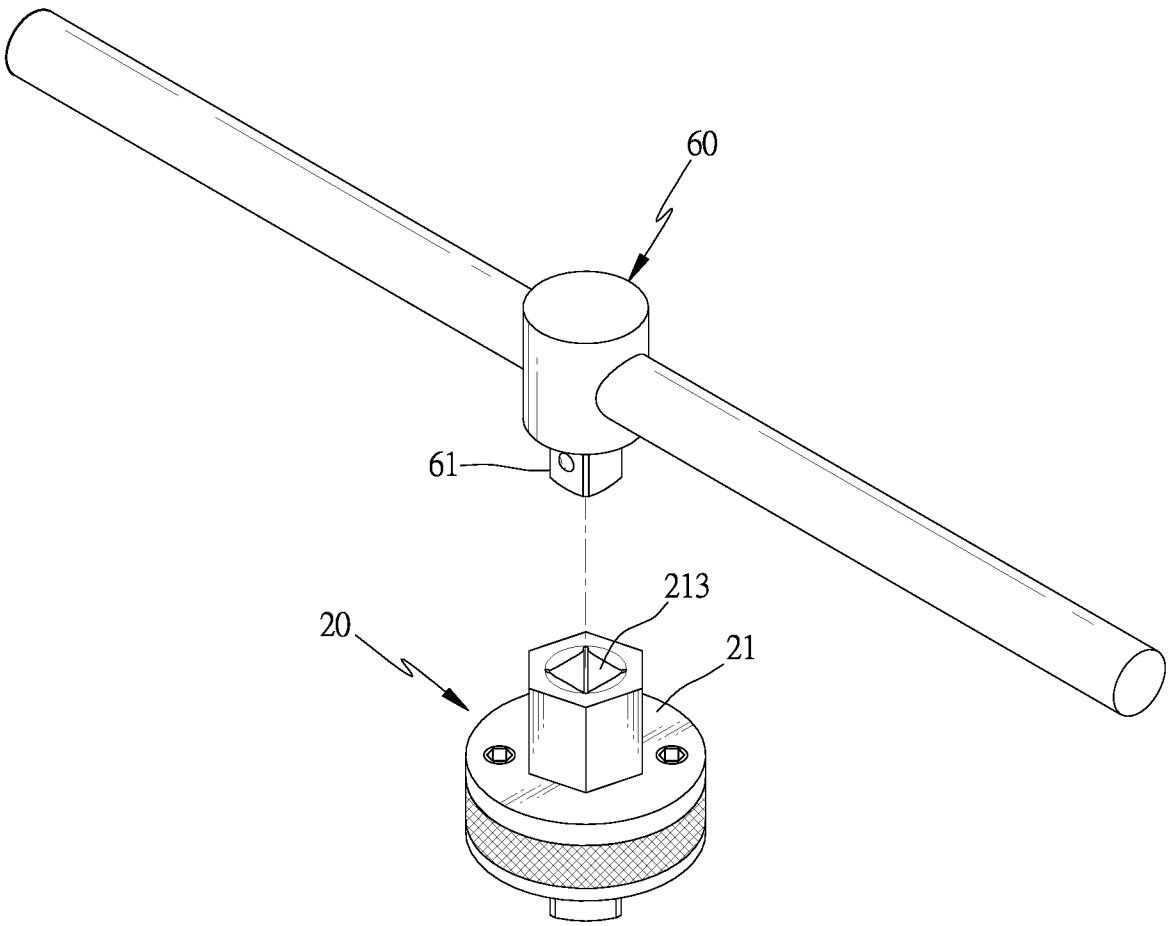
FIG. 13 is another perspective view showing the application of the ratchet device according to the preferred embodiment of the present invention.

With reference to FIG. 13, when the bolt element is removed difficulty, the second fitting portion 213 is fitted with a quadrilateral coupling post 61 of the drive tool 60 (such as the tool bar) so that the drive tool 60 is driven by the user to match with the ratchet device 20, thus saving operation force.

While the preferred embodiments of the invention have been set forth for the purpose of disclosure, modifications of the disclosed embodiments of the invention as well as other embodiments thereof may occur to those skilled in the art. Accordingly, the appended claims are intended to covering assembly all embodiments which do not depart from the spirit and scope of the invention.

What is claimed is:

1. A ratchet device comprising:

a base including at least one accommodation portion arranged in a first end of the base;

a ratchet head accommodated in the at least one accommodation portion of the base and including a first fitting portion and a toothed portion;

at least one retainer accommodated in the at least one accommodation portion of the base and including at least one locking tooth configured to engage with the toothed portion of the ratchet head; and a direction control mechanism including a rotatable driving loop fitted with an outer rim of the base and having at least one engagement portion, at least one actuation element accommodated in the base and driven by the rotatable driving loop to rotate, wherein each of the at least one actuation element has a first pushing element and a second pushing element opposite to the first pushing element, wherein the first pushing element is biased against each of the at least one engagement portion of the rotatable driving loop and is pivotable relative to each of the at least one engagement portion, and the second pushing element abuts against each of the at least one retainer, wherein the direction control mechanism further includes at least one aperture configured to house the at least one actuation element, each of the at least one aperture has a first open portion communicating with the outer rim of the base so that the first pushing element of each actuation element extends out of the first open portion of each aperture, wherein each aperture has a second open portion communicating with each of the at least one second accommodation portions so that the second pushing element of each actuation element extends out of the second open portion of each aperture.

2. The ratchet device as claimed in claim 1, wherein the base includes a first accommodation portion arranged in the first end thereof and configured to accommodate the ratchet head, and the base further includes at least one second accommodation portion communicating with the first accommodation portion so as to accommodate the at least one retainer.

3. The ratchet device as claimed in claim 1, wherein the base further includes a second fitting portion arranged on a second end thereof.

4. The ratchet device as claimed in claim 3, wherein the second fitting portion of the base is a polygonal orifice or a polygonal column.

5. The ratchet device as claimed in claim 1, wherein the rotatable driving loop of the direction control mechanism is fixed on a protruded holding portion of the base, alternatively, a retaining ring and a housing groove are defined between the rotatable driving loop and the base, wherein the retaining ring mates with the housing groove.

6. The ratchet device as claimed in claim 1, wherein each engagement portion of the rotatable driving loop is formed in an indentation shape.

7. The ratchet device as claimed in claim 1, wherein each actuation element has a first receiving hole and a second receiving hole opposite to the first receiving hole, the first receiving hole accommodates a first resilient element and the first pushing element, and the second receiving hole accommodates a second resilient element and the second pushing element.

8. The ratchet device as claimed in claim 7, wherein each actuation element further has two recessed portions arranged on a lower end of the body.

9. The ratchet device as claimed in claim 1, wherein the direction control mechanism further includes a cap covered on the base so as to limit the rotatable driving loop and the at least one actuation element.

* * * * *